US009346657B2

(12) United States Patent
Hanson

(10) Patent No.: US 9,346,657 B2
(45) Date of Patent: May 24, 2016

(54) COLLAPSIBLE AND REUSABLE FUNNEL APPARATUS

(71) Applicant: Roderick Hanson, Sacramento, CA (US)

(72) Inventor: Roderick Hanson, Sacramento, CA (US)

( * ) Notice: Subject to any disclaimer, the term of this patent is extended or adjusted under 35 U.S.C. 154(b) by 0 days.

(21) Appl. No.: 14/546,300

(22) Filed: Nov. 18, 2014

(65) Prior Publication Data

US 2015/0158710 A1 Jun. 11, 2015

Related U.S. Application Data

(60) Provisional application No. 61/907,055, filed on Nov. 21, 2013.

(51) Int. Cl.

| | |
|---|---|
| ***B65B 39/00*** | (2006.01) |
| ***B67C 11/00*** | (2006.01) |
| *B65B 39/06* | (2006.01) |

(52) U.S. Cl.

CPC ..... *B67C 11/00* (2013.01); *B65B 39/06* (2013.01); *B65D 2231/008* (2013.01)

(58) Field of Classification Search

CPC ..... B65B 39/02; B65B 39/06; B67C 11/02; B65D 25/48; B65D 223/007; B65D 223/008

USPC ..... 141/332, 331, 337, 338, 343; 222/460; 215/386; 220/212

See application file for complete search history.

(56) References Cited

U.S. PATENT DOCUMENTS

| | | | | |
|---|---|---|---|---|
| 2,456,912 | A * | 12/1948 | Burrows | B01D 23/28 141/337 |
| 3,915,360 | A | 10/1975 | Lamothe | |
| 4,108,222 | A | 8/1978 | Kaufman | |
| 5,033,521 | A | 7/1991 | Martin | |
| 5,101,870 | A | 4/1992 | Farris | |
| 6,276,411 | B1 * | 8/2001 | Veneziano | B67C 11/02 141/337 |
| 7,240,701 | B2 | 7/2007 | Salani | |
| 2,100,888 | A1 | 1/2011 | Ini-Teva | |
| 2006/0191983 | A1 | 8/2006 | Cargile | |
| 2012/0090724 | A1 * | 4/2012 | Heller | B67C 11/02 141/1 |

* cited by examiner

*Primary Examiner* — Jason K Niesz

(74) *Attorney, Agent, or Firm* — Daniel Boudwin; Global Intellectual Property Agency, LLC

(57) ABSTRACT

A funnel apparatus for storage inside of a container lid. The funnel apparatus includes a circular planar sheet having a centered circular shaped pop-out member with perforated lines therearound to facilitate the removal thereof. The funnel apparatus provides an inner edge and an outer edge, wherein the inner edge is formed after removal of the pop-out member. The device can be removed from a container lid by use of a pull tab that extends from the outer edge thereof. A slit that extends from the inner edge to the outer edge of the planar sheet, wherein the user can separate the device via separating the slit in order to form ends. The device can be formed into a conical shape having a flared open upper and a tapered open bottom, wherein the open bottom is placed into the open upper of a bottle to enable the pouring of liquids and powders therein.

9 Claims, 2 Drawing Sheets

COLLAPSIBLE AND REUSABLE FUNNEL APPARATUS

CROSS REFERENCE TO RELATED APPLICATION

This application claims the benefit of U.S. Provisional Application No. 61/907,055 filed on Nov. 21, 2013. The above identified patent application is herein incorporated by reference in its entirety to provide continuity of disclosure.

BACKGROUND OF THE INVENTION

1. Field of the Invention

The present invention relates to a funnel apparatus that can be placed and stored within the interior volume of a container lid. The funnel apparatus comprises a circular pop-out member having perforations around the perimeter thereof in order to facilitate the removal of the pop-out member from the funnel apparatus. The funnel apparatus further includes a slit extending from an inner edge to an outer edge thereof, allowing the funnel apparatus to be formed into a conical shape with an open upper and open bottom end.

It can be quite difficult to place liquids, powders and the like into narrow bottle spouts and openings. Liquids and powders often fall onto the sides of the bottle creating a mess and wasting the product. People employ the use of funnels in order to properly complete such a task. Conventional funnel systems provide cumbersome structures that are rigid and unyielding, thus being difficult to store and transport and are not quite accommodating to various bottles, lids, containers and the like.

More practical classes of funnel apparatuses involve the use of cartons, containers and the like having detachable funnel apparatuses that are adapted to be used with the container or carton to which it is attached. However, these can be difficult to assemble and are not often able to be reused thereafter. The present invention however, provides a funnel apparatus that is adapted to be stored in the interior volume of a container lid and includes a pop-out member and an integral slit for forming the device into a conical shape for pouring liquids, powders and the like therein.

2. Description of the Prior Art

Devices have been disclosed in the prior art that relate to funnel apparatuses. These include devices that have been patented and published in patent application publications. These devices generally relate to funnel apparatuses that can be integral with cartons or other containers and detached therefrom. The following is a list of devices deemed most relevant to the present disclosure, which are herein described for the purposes of highlighting and differentiating the unique aspects of the present invention, and further highlighting the drawbacks existing in the prior art.

Specifically, U.S. Patent Application Publication No. 2006/0191983 to Cargile describes a carton having an integral and detachable funnel as part of the walls of a storage carton for holding cans or bottles therein. The funnel can be detached from the carton wall by the breaking of a severance line and can be configured to pour products therein. While this may be helpful in the way of storage cartons, it offers little utility for the use with everyday jars and bottles filled with powders and the like.

U.S. Pat. No. 7,240,701 to Salani provides for a collapsible funnel and a method for making the same. The funnel has a plurality of adjacent panels to be attached to one another by means of glue strips. There can be a screen for filtering fluids placed in the funnel. In contrast, the present invention provides a circular shaped structure adapted to be held within a container lid and the like having a perforated circular shaped center, a pull tab, and a slit for forming into a conical structure for insertion into a bottle opening.

U.S. Pat. No. 3,915,360 to Marcel allows for a container with a tear our portion in order to form a funnel that can be positioned in the opening formed therefrom. The user can then pour liquids and the like into the funnel as needed. This device however, is not adapted for household jars and containers having various contents therein, wherein the device is reusable and can be placed into a collapsed position when not in use.

U.S. Pat. No. 5,101,870 to Farris discloses a combination disposable fluid container and disposable funnel, wherein the device provides a separate funnel that conforms to the wall of the container and can be removed therefrom and inverted in order to pour liquids therein for insertion into a bottle and the like. Still, the present invention provides a circular shaped disc structure having a centrally located perforated cutout portion to be removed by the user, wherein the device can be formed into a conical structure and placed into the opening of a bottle for the insertion of powders and the like.

U.S. Pat. No. 2,100,888 to Oscar relates to a collapsible paper funnel construction. The funnel comprises a paper blank having a triangular form that can be folded into a pyramidal structure. The funnel further includes a series of fold lines and a flap to connect the ends of the blank together to form the funnel. The present invention provides a reusable funnel apparatus that can be formed into a conical shape as needed and collapsed as needed into a planar configuration. Further, the present invention provides a slit that enables the device to be formed into a funnel.

Finally, U.S. Pat. No. 4,108,222 to Kaufman provides a collapsible, disposable funnel having a body portion and a movable dam forming a long and narrow structure for insertion into a gas tank opening. While this may be helpful for pouring liquids into a gas tank, it offers little utility for pouring liquids into a bottle. The present invention can readily fit into the container lid of a bottle and rest therein when not in use and can be removed and formed into a funnel when needed. Further, the present invention is reusable.

These prior art devices have several known drawbacks. The above discussed funnel apparatuses do not provide for a funnel apparatus that can be manually formed into a conical shape and can be subsequently collapsed into a planar configuration for storage. Further, the present invention provides a slit that enables the device to be formed into a funnel and can be adapted to fit into the interior volume of a container lid and provides a pull tab for removing the funnel from the container lid. In light of the devices disclosed in the prior art, it is submitted that the present invention substantially diverges in design elements from the prior art and consequently it is clear that there is a need in the art for an improvement to existing funnel devices. In this regard the instant invention substantially fulfills these needs.

SUMMARY OF THE INVENTION

In view of the foregoing disadvantages inherent in the known types of funnel apparatuses now present in the prior art, the present invention provides a new funnel apparatus wherein the same can be utilized for providing convenience for the user when pouring the contents of a jar or container into a bottle having a narrow opening.

It is therefore an object of the present invention to provide a new and improved funnel device that has all of the advantages of the prior art and none of the disadvantages.

It is another object of the present invention to provide a funnel apparatus that is adapted to readily fit within a circular shaped jar or container lid.

Another object of the present invention is to provide a funnel apparatus having a having a circular structure.

Another object of the present invention is to provide a funnel apparatus that is substantially planar.

Another object of the present invention is to provide a funnel apparatus that is flexible and can be configured into a funnel shape by manual manipulation by the user.

Another object of the present invention is to provide a funnel apparatus having a center circular shaped pop-out member having perforations therearound for the removal thereof.

Another object of the present invention is to provide a funnel apparatus having a centered circular shaped hole formed via removal of the pop out member.

Another object of the present invention is to provide a funnel apparatus having an integral slit extending from the circular shaped hole to the edge thereof.

Another object of the present invention is to provide a funnel apparatus having a pull tab.

Yet another object of the present invention is to provide a funnel apparatus that can be readily formed into a conical shaped structure having a tapered bottom for insertion into the narrow opening of a bottle or container.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
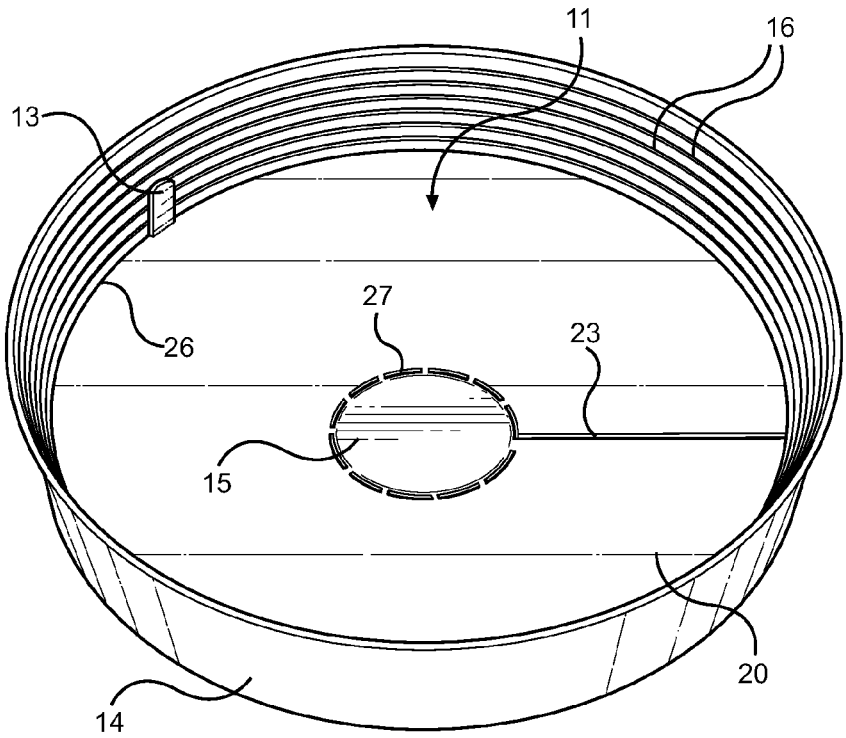
FIG. 1 shows an overhead view of the funnel apparatus placed within the interior volume of a container lid.

Reference is made herein to the attached drawings. Like reference numerals are used throughout the drawings to depict like or similar elements of the funnel apparatus. For the purposes of presenting a brief and clear description of the present invention, the preferred embodiment will be discussed as used for placement into the opening of a bottle for the insertion of powder and liquids therein. The figures are intended for representative purposes only and should not be considered to be limiting in any respect.

Referring now to FIG. 1, there is shown an overhead view of the funnel apparatus 11 placed within the interior volume of a container lid 14. The funnel apparatus 11 provides a circular shaped planar sheet having a planar body an inner edge and an outer edge 26. A pull tab 13 is disposed at the outer edge 26 of the funnel apparatus 11 and comprises a planar oblong shape that outwardly extends therefrom. In operation, a user can grasp the pull tab 13 in order to remove the funnel apparatus 11 from the container lid 14 in which it is positioned for storage. The pull tab 13 can be folded and can rest flush against the circular shaped planar sheet of the funnel apparatus 11.

The circular shaped structure includes an opening covered by a pop-out member 15. The pop-out member 15 is preferably circular in shape and includes perforations 27 about the perimeter thereof, corresponding to the inner edge of the circular shaped planar sheet. In this way, the user can remove the pop-out member 15 along the perforations in order to create a central opening 25 for the funnel apparatus 11. However, the funnel apparatus 11 need not have a pop-out member 15 and a central opening can be provided and can be integral with the funnel apparatus 11 in an alternative embodiment. Further, an integral slit 23 extends from the perimeter of the pop-out member to the outer edge 26 of the funnel apparatus 26, such that the funnel apparatus has a first end and a second end, wherein the slit 23 need not be integral and can be manually created via the user via cutting and the like. Further, there can be perforated lines on the circular planar sheet of the funnel apparatus 11 in an alternative embodiment that extends from the perimeter of the pop-out member 15 to the outer edge 26 of the funnel apparatus 26 in order enable the user to tear at the perforated lines in order to create a slit 23.

The funnel apparatus 11 is adapted to be utilized with a standard circular shaped container lid 14 of a container having a base, sidewalls, an exterior surface and an interior surface, wherein the container lid 14 provides sidewalls defining an interior volume and an open upper end. The sidewalls of the container lid 14 may provide a threaded portion 16 on the interior surface thereof, wherein the funnel apparatus 11 is adapted to readily fit into the interior volume of the container lid 14 and the outer edge 26 thereof can remain therein via resting in a stable position within the threaded portion 16 of the interior surface of the sidewalls. The threaded portion 16 helps to create a friction and enables the outer edge 26 of the funnel apparatus 11 to rest firmly therein without sliding, falling or slipping from the container lid 14.

The user can place the funnel apparatus 11 within the interior volume of a container lid 14, wherein the first side thereof can rest against the interior surface of the base of the container lid 14 and remain flush therewith. The outer edge 26 of the funnel apparatus 11 can contact the interior surface of the sidewalls of the container lid 14, wherein the pull tab 13 can extend perpendicularly from the outer edge 26 of the funnel apparatus 11 and remain flush against the interior surface of the sidewalls of the container lid 14 in the threaded portion 16 thereof. The container lid 14 having the funnel apparatus 11 secured therein can be secured to the corresponding container and can remain therein and will not become dislodged therefrom until manually removed by the user.

Figure 2:
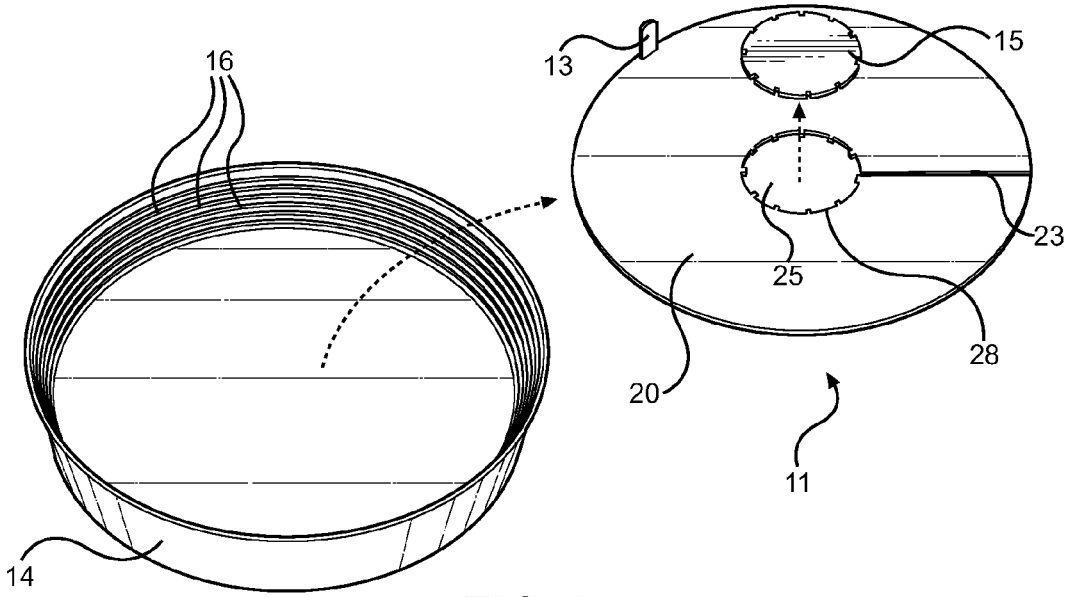
FIG. 2 shows an overhead view of the funnel apparatus as removed from a container lid.

Referring now to FIG. 2, there is shown an overhead view of the funnel apparatus 11 having a circular shaped structure and a central opening 25, wherein the pull tab 13 is shown. The funnel apparatus 11 is adapted to remain in the interior volume of a container lid 14 for storage thereof, however, it can be placed and stored in various holding spaces and is not limited as such. The user can remove the funnel apparatus 11 from the interior volume via manually grasping the pull tab 13 and drawing it upward and away from the interior volume of the container lid 14, thus lifting the funnel apparatus 11 therefrom.

The funnel apparatus 11 provides a circular shaped or disc structure having a pop out member 15 comprising a circular shape, wherein the pop out member 15 provides perforated lines 27 therearound. The user can manually dislodge the pop out member 15 from the body of the funnel apparatus 11 along the perforated lines 27 via pulling, tearing or pushing the pop out member 15 therefrom, thus revealing an opening 25 and defining an inner edge 28. The opening 25 created after the removal of the pop out member 15 is centrally disposed in the body of the funnel apparatus, but can be disposed in an off center or askew location in the body of the funnel apparatus 11 in an alternative embodiment. The opening 25 enables the user to form a conical shape having a flared open upper, wherein the outer edge 26 forms a straight and planar edge and the inner edge 28 forms a tapered open bottom.

The funnel apparatus 11 provides an integral slit 23 that extends from the inner edge 28 to the outer edge 26 of the funnel apparatus 11 to allow the user to form it into a conical shape. The funnel apparatus 11 is sufficiently flexible and can be manually manipulated as desired and formed into a conical shape of various sizes as desired by the user. However, the funnel apparatus can be formed into a tubular shape, cylindrical shape and/or other shapes that facilitate the pouring of powders, liquids and the like therethrough and into a bottle. The funnel apparatus can be constructed from plastic, paper, aluminum, cotton, polypropylene, polyethylene, polyvinyl chloride, polyethylene, terephthalate and/or other suitable materials. Further, the funnel apparatus 11 can be made in a material that maintains the freshness of the contents of the container and container lid 14 to which it is applied such that the funnel apparatus 11 can rest within a container lid 14 of a container as described above while also acting as a seal to the container and the contents therein. As such, the funnel apparatus 11 can be of a substantial thickness and made from a material that preserves food, liquids, powders and the like and prevents the entry of moisture, air and foodstuff spoiling elements and the like. The funnel apparatus can be made in various sizes in order to accommodate different sized lids and caps.

Figure 3:
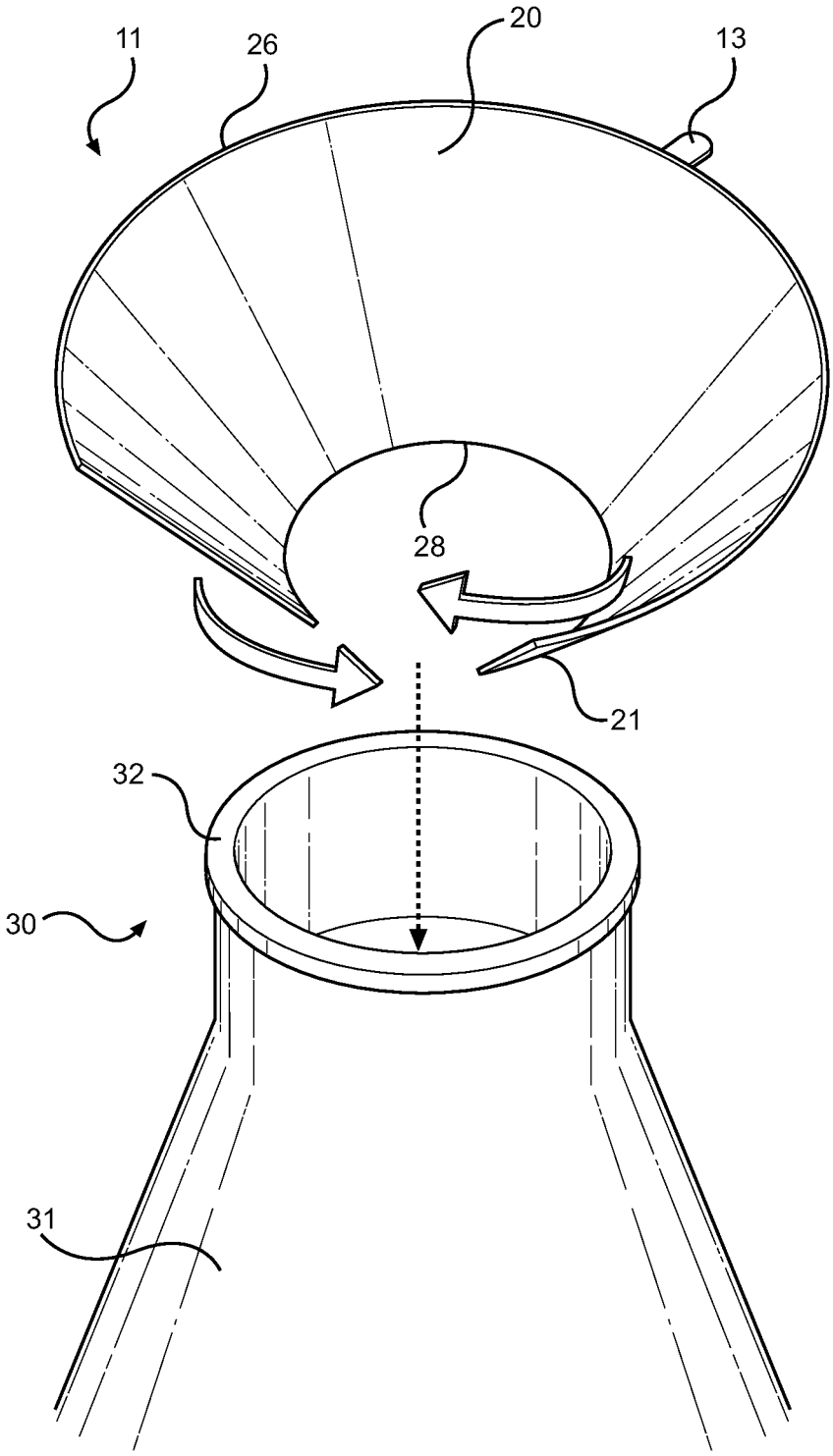
FIG. 3 shows a view of the funnel apparatus forming into a conical structure having a wide open upper and a tapered bottom for insertion into a bottle opening.

FIG. 3 shows a view of the funnel apparatus 11 forming into a conical shape having a flared open upper and a tapered bottom for insertion into the open upper 30 of a bottle 31. After the removal of the pop out member 15 from the body of the funnel apparatus 11, the user can grasp body of the funnel apparatus 11 and separate the device via pulling at the slit 23, such that the funnel includes a first end and a second end. The user can then manually manipulate the funnel apparatus 11 into a conical shape having a flared open upper with a substantially straight edge and a tapered open bottom, wherein the opening 25 and inner edge 28 of the funnel apparatus forms the tapered open bottom and the outer edge 26 forms the flared open upper.

The user can then place the funnel apparatus 11 formed into a conical shape into the open upper 30 of a bottle 31 or container, wherein the bottle 31 provides a base and a unitary wall having a first side and a second side forming an interior volume and having a narrow and tapered open upper 30 having a circular shape and a border 32. The user can place the inner edge 28 that is formed into a tapered open bottom and thus a circular shape into the open upper 30 of the bottle 31, wherein the tapered open bottom and thus the inner edge 28 can rest partially within the interior volume of the bottle and the first side 21 of the funnel apparatus can contact the second side of the unitary wall of the bottle. The funnel apparatus 11 can remain within the open upper in a stable conical shape thereafter, wherein the user can then proceed to pour a powder, liquid or other substance into the flared open upper of the funnel apparatus. The liquid or powder will then slide downward the second side 20 of the funnel apparatus and through the tapered open bottom thereof and into the interior volume of the bottle 31 or other container with which it is utilized.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cap and funnel assembly comprising:

a container cap having an interior diameter;

a circular planar sheet having an opening, an inner edge corresponding to a perimeter of the opening, and an outer edge;

wherein the circular shaped planar sheet has a diameter configured to conform to the interior diameter of the container cap;

a slit extending from the inner edge to the outer edge, the slit separating a first end of the circular planar sheet and a second end of the circular planar sheet;

wherein said circular shaped planar sheet is foldable into a conical shape via overlapping the first end and the second end.

2. The cap and funnel assembly of claim 1, wherein the circular planar sheet is configured to rest flush against an interior surface of the container cap.

3. The cap and funnel assembly of claim 1, further comprising:

a threaded portion disposed on an interior surface of a sidewall of the container cap;

wherein the threaded portion is configured to secure the circular planar sheet within an interior volume of the container cap.

4. The cap and funnel apparatus of claim 1, further comprising a circular shaped pop-out member disposed on said opening and connected to said inner edge by means of perforated lines such that said pop-out member is removable from said circular shaped planar sheet.

5. The cap and funnel apparatus of claim 4, wherein said circular shaped pop-out member is off-center on said planar sheet.

6. The cap and funnel apparatus of claim 1, said circular shaped planar sheet composed of a flexible material.

7. The cap and funnel apparatus of claim 1, said funnel apparatus further being collapsible.

8. The cap and funnel apparatus of claim 1, said outer edge further comprising a pull tab extending therefrom.

9. The cap and funnel apparatus of claim 1, wherein said slit is substantially linear.

* * * * *